US008832877B2

(12) United States Patent
Pillay

(10) Patent No.: US 8,832,877 B2
(45) Date of Patent: Sep. 16, 2014

(54) COMPOSITE DISPOSABLE BED LINEN PACKAGE

(76) Inventor: Mogambiree Pillay, Mairangi Bay (NZ)

( * ) Notice: Subject to any disclaimer, the term of this patent is extended or adjusted under 35 U.S.C. 154(b) by 0 days.

(21) Appl. No.: 12/942,040

(22) Filed: Nov. 9, 2010

(65) Prior Publication Data

US 2014/0000028 A1 Jan. 2, 2014

(51) Int. Cl.
*A47G 9/00* (2006.01)

(52) U.S. Cl.
USPC ..... 5/487; 5/482; 5/498

(58) Field of Classification Search
USPC ..... 5/482, 485, 486, 490, 501–502, 497
See application file for complete search history.

(56) References Cited

U.S. PATENT DOCUMENTS

| | | | | |
|---|---|---|---|---|
| 4,924,543 | A | 5/1990 | Hoss et al. | |
| 6,049,925 | A * | 4/2000 | Lewis | 5/497 |
| 6,088,852 | A | 7/2000 | Quandt | |
| 6,122,782 | A * | 9/2000 | Chedid | 5/495 |
| 6,128,796 | A * | 10/2000 | McCormick et al. | 5/626 |
| 7,600,279 | B1 * | 10/2009 | Cameron | 5/482 |
| 2009/0205133 | A1 | 8/2009 | Thomas | |

FOREIGN PATENT DOCUMENTS

| | | |
|---|---|---|
| WO | WO-87-01919 | 4/1987 |
| WO | WO-03-103461 | 12/2003 |

* cited by examiner

*Primary Examiner* — Fredrick Conley
(74) *Attorney, Agent, or Firm* — Mark R. Malek; Zies Widerman & Malek

(57) ABSTRACT

Disclosed is a composite disposable bed linen package that combines the individual bed linen elements of fitted bottom sheet, top sheet and pillow case into a single element so assembled and attached to meet the specific needs of health-care applications. The composite disposable bed linen package is designed for, but not limited to, single occupancy institutional beds.

9 Claims, 3 Drawing Sheets

COMPOSITE DISPOSABLE BED LINEN PACKAGE

TECHNICAL FIELD

This invention relates to a composite disposable bed linen package that combines the individual bed linen elements of fitted bottom sheet, top sheet and pillow case into a single element so assembled and attached to meet the specific needs of healthcare applications. The composite disposable bed linen package is designed for, but not limited to, single occupancy institutional beds.

RELATED APPLICATION

This is a complete specification in support of provisional patent No. 581329 dated 23 Nov. 2009 and is a patent of addition in accordance with the Patents Act 1953 and refers to New Zealand Provisional Patent No. 579291 filed 27 Aug. 2009, accepted 10 Nov. 2009.

BACKGROUND OF THE INVENTION

Disposable bed linen is increasingly used in developed countries, particularly in healthcare facilities. These have particular application in areas of healthcare with a high daily turnover of patients, usually emergency care wards, outpatients and support services such as diagnostic and treatment centres, XRay, MRI facilities and on gurneys and ambulance stretchers. These are currently used in conjunction with individual top sheets and pillow cases.

These are areas where support staff work under stressful and demanding conditions so continual handling and occasional misplacing of individual bed linen items can significantly impair efficiency. Combining the most commonly used items into a single package eliminates all possibility of misplacing items. A single package can be allocated to every person being attended to and eases the demands on support staff.

Replacing bed linen is an arduous task for healthcare and institutional support staff and this package is designed to make this more time efficient. The invention also eliminates the need for an inventory of individual items as the composite disposable bed linen package replaces 3 individual items.

In addition to the elimination of 3 individual items, these single packs can be readily stored on site and packaging and shipping is also simplified. Depending on the fabric used, the volume and mass of the package will be significantly lower than conventional re-useable linen. As an example, single use disposable fabric preferred for use in healthcare settings, has a density of approximately 60 grams per square meter as opposed to 180 grams per square meter for a cotton rich fabric. A cotton rich fabric has a mass and volume 3 times greater than a non woven disposable alternative.

This is particularly relevant in emergency field hospitals and in remote areas of developing countries in simplifying logistics management.

Military hospitals and staff accommodation require packaged facilities to ensure rapid deployment in areas of need, particularly in times of natural disaster. A composite disposable bed linen package will meet these needs and give users the assurance that they have access to reasonably sterile linen that meets with accepted infection control standards.

The design of this package eliminates zips, clips, ties and hook and loop fasteners and relies on the fitted bottom sheet to secure it in position. This an important infection control consideration as these fixings are difficult to clean and disinfect and can provide an environment for the growth of micro organisms.

The availability of an infection free option such as the composite disposable bed linen package will ensure greater adherence to infection control requirements.

Healthcare facilities in developing countries and institutional facilities (such as military barracks, dormitories, and prisons) typically have bunk style beds with minimal headboard support. These require the use of a pillow to supplement back support for sitting upright in bed and the composite disposable bed linen package accommodates this.

Theft of bed linen is a problem in many countries. The composite disposable bed linen package is ideal in communities where this is a problem as it is designed specifically for institutional use and has little commercial appeal.

In addition to obvious healthcare applications, the composite disposable bed linen package is ideal for prison services, particularly in holding cells. It has uses in hostels and dormitories for short stay visitors who need the assurance of clean and hygienic sleeping facilities.

SUMMARY OF THE INVENTION

The fabric used in the manufacture of the composite disposable bed linen package may be of either natural, synthetic or recycled material or any combination of these as they are all ultimately disposable. In the healthcare context disposable linen is qualified as being "single use disposable linen" and the textile used is what is generically termed non woven disposable fabric. This textile technology is continuously evolving and these are subject to various patents and usually described using proprietary trade names. Further specific definition of the type of fabric is beyond the scope of this specification.

The primary component of the invention is a fitted bottom sheet with pre-formed pockets at the ends that are tucked around the mattress at the head and foot end. Fitting the package entails fitting the pre-formed pocket to the mattress at the foot of the bed first, then unfolding the composite disposable bed linen package to fit the pre-formed pocket to the mattress at the head of the bed.

In the preferred embodiment, the package is made up using a single length of fabric that is cut to suit. This eliminates the need to join individual fabric lengths by stitching.

The top sheet is attached to the bottom sheet pocket at the foot of the bed for the full width underneath the mattress in a manner that ensures the tensile strength of the fabric is not compromised by end stitching.

Any tension on the top sheet resulting from a person pulling whilst lying prone is partly dissipated by the contact with the mattress edges as well as friction between the sheet and the underside of the mattress. This relieves some of the stress in the joint with the fitted top sheet.

Unfolding the bottom sheet onto the bed simultaneously unfolds the top sheet and this is how economy in time management is achieved. Similarly stripping the bed entails removing the pocket at the head of the bed and folding the package until the pocket at the foot of the bed is removed. The longitudinal edges of the top sheet are not attached to the bottom sheet and so allow entry and egress on either side as is done using conventional bed linen.

For healthcare applications, access to the feet is vital for observation and therapy. This is particularly so where blood circulation and wounds to the lower limbs are monitored post operatively. This is accommodated by attaching the top sheet to the bottom sheet at a point that is under the mattress in the preferred embodiment. This ensures the top sheet has the ability to be pulled away from the sides of the bed allowing either bottom edge of the sheet to be partially lifted or folded back whilst the sheet is still attached.

In surgical applications, the package will be used in conjunction with reusable surgical drapes that provide some degree of patient privacy. In this instance the top sheet may be shortened or omitted as use of the surgical drapes may render the top sheet superfluous.

The pillow case is pre-sewn integrally with the bottom sheet and is provided with a double seam at the joint between bottom sheet and pillow case, allowing the pillowcase to pivot about this seam enabling the pillow to be used horizontally or vertically.

DETAILED DESCRIPTION OF THE DRAWINGS

Figure 1:
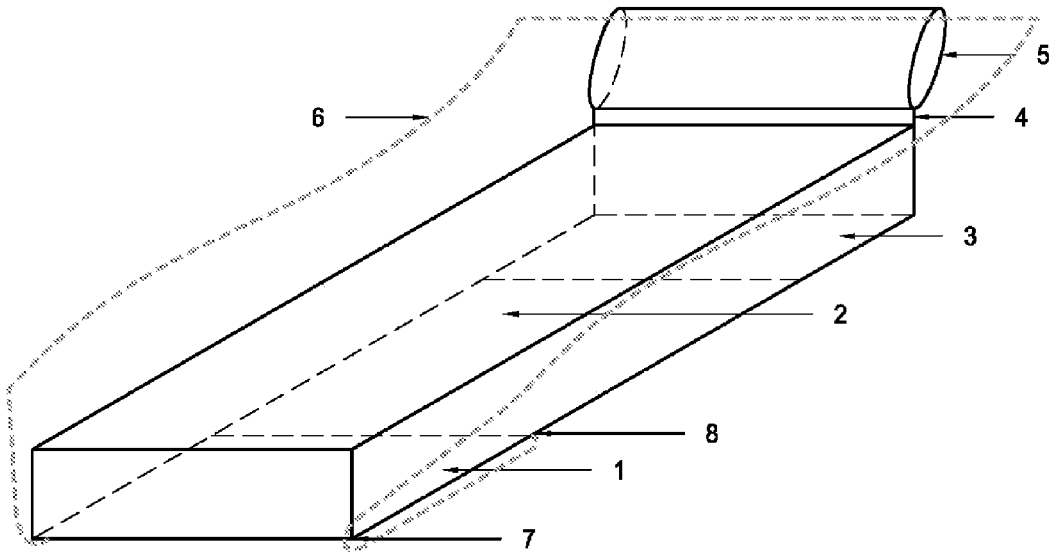
FIG. 1: illustrates an isometric view of the completed package with the top sheet ghosted in fainter lines

FIG. 1 provides an overview of the finished package.

Item 1 is the pocket sewn on at the foot of the bottom sheet and is the item initially fitted under the mattress prior to the package being unfolded onto the bed. The composite disposable bed linen package will be tailored to suit modern institutional beds and may optionally incorporate an elasticised fitting around the bottom perimeter of the mattress. This optional feature will accommodate non standard mattresses with slight variations in sizes used in field hospitals and in developing countries.

Item 2 is the bottom sheet and is the base element that provides the attachment for the other bed linen elements.

Item 3 is the pocket sewn on the head of the bottom sheet and the item fitted second under the mattress. With the fitting of this item the process is almost complete and demonstrates the ease of use.

Item 4 is the double seam used to attach and form the pillowcase and allows the pillowcase to pivot about this seam. This is essential in allowing the flexibility of use described.

Item 5 is the pillowcase attached by means of the double seam Item 4.

Item 6 is the top sheet which may optionally be shortened in length or omitted if used in surgical theatres in combination with surgical drapes.

Item 7 is an optional location of a seam to attach the top sheet to the fitted bottom sheet if it is desired to utilise 2 separate fabric lengths to assemble the composite disposable bed linen package.

Item 8 is the preferred location of attachment of the top sheet to the bottom sheet as it eliminates the need for an end stitch along the width of the sheet. It is in effect a fold along the width of the sheet to form the top sheet when a single fabric length is used for the composite disposable linen package in its preferred embodiment.

Figure 2:
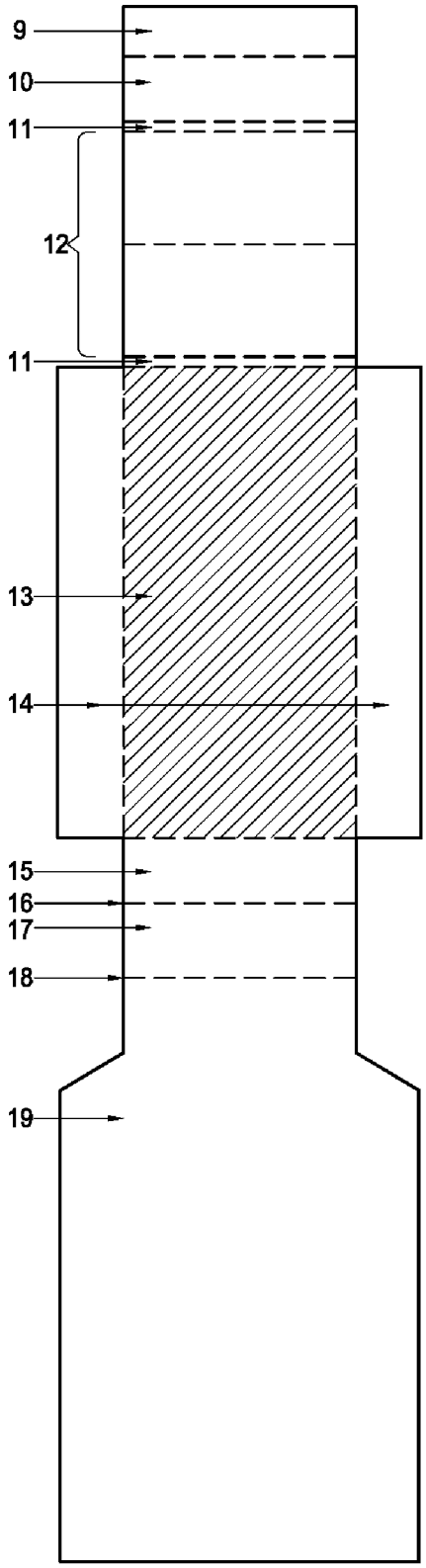
FIG. 2: illustrates the developed plan view of the single sheet of fabric for the preferred embodiment of the entire package as cut for fabrication and shows fold lines

FIG. 2 represents the fabric in its preferred embodiment as a single piece with the lighter dashed lines representing folds that show how the assembly of the composite package is achieved.

Item 9 is the horizontal base of the pocket at the head of the bed.

Item 10 is the pocket vertical at the head of the mattress.

Items 11 are the seams that enable the pillow case to pivot and are crucial to the flexible adaptation of the composite disposable bed linen package to the potential end uses.

Items 12 are the top and bottom of the pillow case.

Item 13 is the horizontal base of the bottom sheet shown hatched.

Items 14 are the side verticals along each longitudinal side of the mattress.

Item 15 is the pocket vertical at the foot of the bed.

Item 16 is the optional location of the seam for the top sheet attachment to the bottom sheet where separate fabric lengths are used.

Item 17 is the base of the pocket at the foot of the bed.

Item 18 is the fold line where the top sheet folds back under the mattress in the preferred embodiment of the composite package.

Item 19 is the underside on the top sheet and overlies the bottom sheet Item 13.

Figure 3:
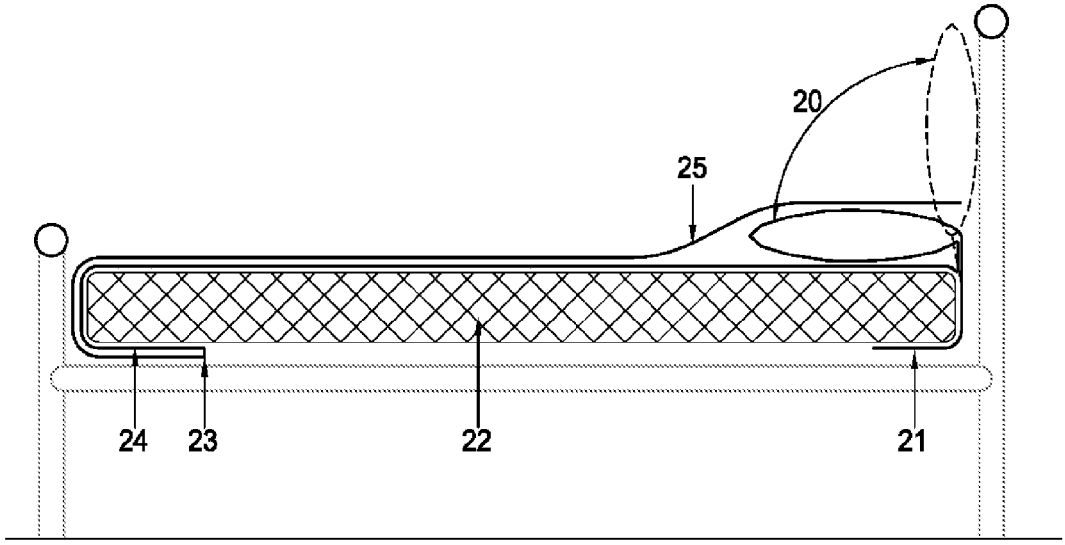
FIG. 3: illustrates the side elevation or longitudinal section along the length of the bed showing the attachment of the various elements

FIG. 3 represents a side view or longitudinal section of the bed showing the elements that make up the composite package.

Item 20 illustrates the pivoting action of the pillow case to ensure its flexibility of use either as a conventional pillow horizontal on the bed whilst sleeping or as a backrest whilst seated upright in bed Item 21 is the base of the pocket under the mattress at the head of the bed and is the primary means of attaching the composite package to the bed.

Item 22 is the mattress shown cross hatched.

Item 23 is the point of attachment of the top sheet to the bottom sheet in the preferred embodiment and enables the top sheet to be folded back under the mattress when a single fabric length is used.

Item 24 is the base of the pocket under the mattress at the foot of the bed and is the item first fitted to the bed.

Item 25 is the top sheet in position immediately prior to the bed being occupied.

Figure 4:
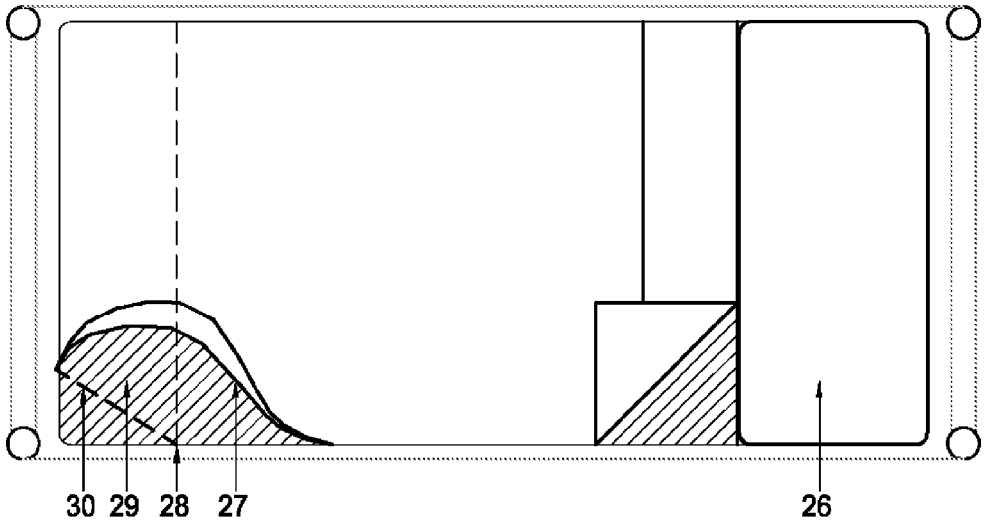
FIG. 4: illustrates a plan view of the bed with the completed package in place showing how access to the lower limbs is achieved in a healthcare setting

FIG. 4 is a plan view of the bed with the composite package fitted and demonstrates how access to the lower limbs is achieved in a healthcare setting without lifting the entire top sheet and compromising patient privacy and modesty.

Item 26 is the pillowcase and pillow at the head of the bed.

Item 27 is the top sheet as folded back to reveal one of the lower limbs if required.

Item 28 is the point of attachment of the top sheet under the mattress in the preferred embodiment.

Item 29 is the bottom sheet, shown as hatched.

Item 30 is the line of the top sheet below the mattress when pulled back from the point of attachment Item 28 in order to provide the maximum exposure of the area of the lower limb.

The preceding is a description of the invention by way of example and it should be understood that improvements and modifications may be made thereto without departing from the scope or spirit of the invention.

The invention claimed is:

1. A composite bed linen package to be used in connection with a mattress and comprising:

a fitted bottom sheet having a top portion and a bottom portion opposite the top portion, and including preformed pockets, the fitted bottom sheet having a first width;

a top sheet including a pair of longitudinal edges, a top portion and a bottom portion opposite the top portion, the bottom portion being connected to the fitted bottom sheet and having a width that is similar to the first width, wherein the top portion of the top sheet has a second width that is wider than the first width, and wherein the top portion of the top sheet includes a pair of opposing recessed areas to transition the second width to the first width;

a pillow case connected to the fitted bottom sheet at the top portion thereof using a seam that enables the pillow case to pivot with respect to the fitted bottom sheet; and a pocket portion connected to the pillow case that is foldable back to a position adjacent to a portion of the fitted bottom sheet when the fitted bottom sheet engages a mattress;

wherein the preformed pockets formed in the fitted bottom sheet are adapted to engage corner portions of the mattress;

wherein the bottom portion of the fitted bottom sheet is adapted to be positioned under the mattress when applied thereto;

wherein the bottom portion of the top sheet is coupled to the fitted bottom sheet adjacent to the bottom portion of the fitted bottom sheet and also adapted to be positioned under the mattress;

wherein the recessed areas of the top sheet are not attached to the fitted bottom sheet along the entire width thereof;

wherein the bottom portion of the top sheet is foldable back towards a medial portion of the top sheet while the top sheet remains coupled to the fitted bottom sheet to provide access to an area underneath the top sheet;

wherein a lower perimeter of the fitted bottom sheet is elasticized to assist in fixing the fitted bottom sheet to the mattress;

wherein the longitudinal edges of the top sheet are not attached to the fitted bottom sheet;

wherein the fitted bottom sheet, the top sheet, and the pillow case are formed from a single length of fabric;

wherein the top portion of the top sheet having the second width is positioned over the mattress; and wherein the fitted bottom sheet, the top sheet, and the pillow case are formed from a single length of fabric.

2. The composite bed linen package according to claim 1 where the top sheet is attached to the fitted bottom sheet along the full width of the fitted bottom sheet adjacent the bottom portion of each of the fitted bottom sheet and the top sheet.

3. The composite bed linen package according to claim 1 wherein the seam connecting the pillow case to the fitted bottom sheet is a double seam, enabling a pillow placed in the pillow case to be used horizontally or vertically.

4. A composite bed linen package to be used in connection with a mattress and comprising a fitted bottom sheet having a top portion and a bottom portion opposite the top portion, and including preformed pockets, the fitted bottom sheet having a first width;

a top sheet including a pair of longitudinal edges, a top portion and a bottom portion opposite the top portion, the bottom portion being connected to the fitted bottom sheet and having a width that is similar to the first width, wherein the top portion of the top sheet has a second width that is wider than the first width, and wherein the top portion of the top sheet includes a pair of opposing recessed areas to transition the second width to the first width;

a pillow case connected to the fitted bottom sheet adjacent to the top portion thereof using a seam that enables the pillow case to pivot with respect to the fitted bottom sheet; and a pocket portion connected to the pillow case is foldable back to a position adjacent to a portion of the fitted bottom sheet when the fitted bottom sheet engages a mattress;

wherein the preformed pockets formed in the fitted bottom sheet are adapted to engage corner portions of the mattress;

wherein the bottom portion of the fitted bottom sheet is adapted to be positioned under the mattress when applied thereto;

wherein the bottom portion of the top sheet is coupled to the fitted bottom sheet adjacent to the bottom portion of the fitted bottom sheet and also adapted to be positioned under the mattress;

wherein the bottom portion of the top sheet is foldable back towards a medial portion of the top sheet while the top sheet remains coupled to the fitted bottom sheet to provide access to an area underneath the top sheet;

wherein the top portion of the top sheet having the second width is adapted to be positioned over the mattress; and wherein the bottom portion of the top sheet having the first width is adapted to be positioned under the mattress.

5. The composite bed linen package according to claim 4 wherein a lower perimeter of the fitted bottom sheet is elasticized to assist in fixing the fitted bottom sheet to the mattress.

6. The composite bed linen package according to claim 4 wherein the longitudinal edges of the top sheet are not attached to the fitted bottom sheet.

7. The composite bed linen package according to claim 4 where the top sheet is attached to the fitted bottom sheet along the full width of the bottom portion of the top sheet.

8. The composite bed linen package according to claim 4 wherein the seam connecting the pillow case to the fitted bottom sheet is a double seam, enabling a pillow placed in the pillow case to be used horizontally or vertically.

9. The composite bed linen package according to claim 4 wherein the fitted bottom sheet, the top sheet, and the pillow case are formed from a single length of fabric.

* * * * *